US009108306B2

(12) United States Patent
Hecht et al.

(10) Patent No.: US 9,108,306 B2
(45) Date of Patent: Aug. 18, 2015

(54) MACHINE TOOL HAVING A SPINDLE DRIVEN BY A DRIVE DEVICE

(75) Inventors: Joachim Hecht, Magstadt (DE); Heiko Roehm, Stuttgart (DE); Martin Kraus, Filderstadt (DE)

(73) Assignee: ROBERT BOSCH GMBH, Stuttgart (DE)

( * ) Notice: Subject to any disclaimer, the term of this patent is extended or adjusted under 35 U.S.C. 154(b) by 980 days.

(21) Appl. No.: 13/143,719

(22) PCT Filed: Nov. 25, 2009

(86) PCT No.: PCT/EP2009/065800
§ 371 (c)(1),
(2), (4) Date: Sep. 27, 2011

(87) PCT Pub. No.: WO2010/079002
PCT Pub. Date: Jul. 15, 2010

(65) Prior Publication Data

US 2012/0006575 A1 Jan. 12, 2012

(30) Foreign Application Priority Data

Jan. 8, 2009 (DE) ..... 10 2009 000 065

(51) Int. Cl.
*B25B 21/00* (2006.01)
*B25B 23/14* (2006.01)
*B25F 5/00* (2006.01)

(52) U.S. Cl.
CPC ..... *B25B 21/00* (2013.01); *B25F 5/001* (2013.01)

(58) Field of Classification Search
CPC ..... B25B 21/00; B25B 23/14; B25F 5/00; B25F 5/001
USPC ..... 173/216–217, 213
See application file for complete search history.

(56) References Cited

U.S. PATENT DOCUMENTS

| | | | | |
|---|---|---|---|---|
| 5,016,501 | A | 5/1991 | Holzer, Jr. | |
| 6,715,562 | B1 | 4/2004 | Chen | |
| 7,008,151 | B2 * | 3/2006 | Yaksich et al. | 408/240 |

FOREIGN PATENT DOCUMENTS

| | | |
|---|---|---|
| CN | 1789741 | 6/2006 |
| CN | 1789742 | 6/2006 |
| DE | 699 21 250 | 3/2006 |
| EP | 1 083 029 | 3/2001 |
| EP | 1 652 631 | 5/2006 |

OTHER PUBLICATIONS

International Search Report for PCT/EP2009/065800, dated , Mar. 19, 2010.

* cited by examiner

*Primary Examiner* — Michelle Lopez
(74) *Attorney, Agent, or Firm* — Kenyon & Kenyon LLP

(57) ABSTRACT

Disclosed is a machine tool having a spindle driven by a drive device, the spindle having a receiving device on its free end for a tool or a tool holder, an input part being provided in the drive train of the drive device, the input part transferring a torque having a defined play in the direction of rotation via drivers to an output part which is joined in a rotationally fixed manner to the spindle, while a torque acting from the spindle in the direction of the drive device and exceeding a torque on the input side is supported on the housing of the machine tool via clamping surfaces on the periphery of the output part, via clamping elements and via a locking ring having a hollow cylindrical surface. The output part is a driving profile having two or more axially parallel planes, of which a first part acts as clamping surfaces and a second part acts as driving surfaces which cooperate with the drivers of the input part.

7 Claims, 2 Drawing Sheets

MACHINE TOOL HAVING A SPINDLE DRIVEN BY A DRIVE DEVICE

FIELD OF THE INVENTION

The present invention is directed to a machine tool having a spindle driven by a drive device.

BACKGROUND

Machine tools, in particular electric tools, such as cordless screwdrivers, cordless combi drills, and cordless impact drills, have a drive motor, usually an electric motor, which drives a spindle via a single-stage or multi-stage gear unit. The spindle contains a tool holder. It is also possible for the tool holder to be fastened to the spindle in a rotationally fixed, but detachable, manner. Frequently the machine tools, in particular hand-held electric tools, have a spindle lock driver. The spindle lock driver is situated in the drive train between the drive motor and the spindle and allows the spindle to rotate in the housing if the torque applied to the spindle from the outside is less than from a driver on the gear unit side. If the torque applied from the tool holder to the spindle from the outside is greater than from the driver on the gear unit side, the spindle lock driver locks the spindle with respect to the housing. This allows, for example, a drill chuck to be opened without additional manual operation of the spindle lock, or the performance of work cases requiring higher torque than the electric motor is able to generate. Furthermore, it is possible to remove drill bits from a bore by rotating the machine tool.

A machine tool having an electric motor, which drives a spindle having a chuck via a countershaft gear unit, is known from German Patent Publication DE 699 21 250 T2. The countershaft gear unit is made up of a pinion which is connected in a rotationally fixed manner to the motor shaft and meshes with a countershaft gear wheel which is rotationally supported on a countershaft. Another countershaft pinion, which fixedly rests on the countershaft, meshes with an output gear wheel which is rotationally fixed to the spindle.

A spindle lock driver which includes a prismatic output part is accommodated in a cylindrical chamber fixed to the housing which includes the countershaft on the input side. Longitudinal grooves which engage the axially directed finger-like drivers having play in the circumferential direction are provided on the edges of the prism. The drivers are formed on the countershaft gear wheel. Clamping rollers are provided between the prism surfaces and the inner wall of the cylindrical chamber or a bushing which is fixed to the housing and situated in the chamber. In normal operation, the torque of the electric motor is transferred via the pinion to the countershaft wheel and from there via the driver to the output part which rests fixedly on the countershaft. The countershaft pinion is driven by the countershaft, the countershaft pinion meshing with the output gear wheel and thus driving the spindle. If the torque transferred from the output gear wheel to the countershaft is greater than the torque transferred from the countershaft wheel, the output part twists against the drivers within the predefined play and the clamping rollers exert a clamping action between the output part and the cylindrical chamber fixed to the housing, so that the torque generated by the spindle is supported on the housing and blocks the spindle.

SUMMARY

According to the present invention, the output part is a prismatic driving profile having two or more axially parallel planes, of which a first part acts as clamping surfaces and a second part acts as driving surfaces which cooperate with the drivers of the input part. In this connection, the drivers may be supported on the driving surfaces symmetrical to the clamping surfaces. According to another preferred embodiment, the clamping surfaces are situated axially offset from the driving surfaces. The driving surfaces may continuously transition into the clamping surfaces or preferably form one plane with the clamping surfaces.

The embodiments according to the present invention make it possible to achieve higher precision at low expense, since one contact surface of the driver is an extension of the clamping surface. The precision is further increased by shorter tolerance chains using identical manufacturing methods. The contact surfaces result in low surface pressures, which in particular has a favorable effect on the service life and functionality of the spindle lock driver if there are torque shocks.

The robust spindle lock driver makes it possible for it to be engaged directly on the spindle, so that the high torques which frequently experience torque shocks and may be transferred from the spindle are not conducted across sensitive gear parts. This is of particular advantage if a planetary gear set is used as an end stage, the planet carriers of which have drivers which interact with driving surfaces of the driving profile of the spindle with a defined play. In this connection, it is advantageous to form guides on the planet carrier in the circumferential direction between the drivers, the guides interacting with rounded edges of the prismatic driving profile. The rounded edges form partial surfaces of a surrounding circular cylinder. This ensures that the planet carrier including its, if necessary, axially lengthened guides are guided reliably on the spindle supported in the housing.

Additional advantages are derived from the following drawing description. One exemplary embodiment of the present invention is shown in the drawings. The drawings, the description and the claims contain numerous features in combination. The person skilled in the art will also expediently observe the features individually and combine them into additional practical combinations.

DETAILED DESCRIPTION

Figure 1:
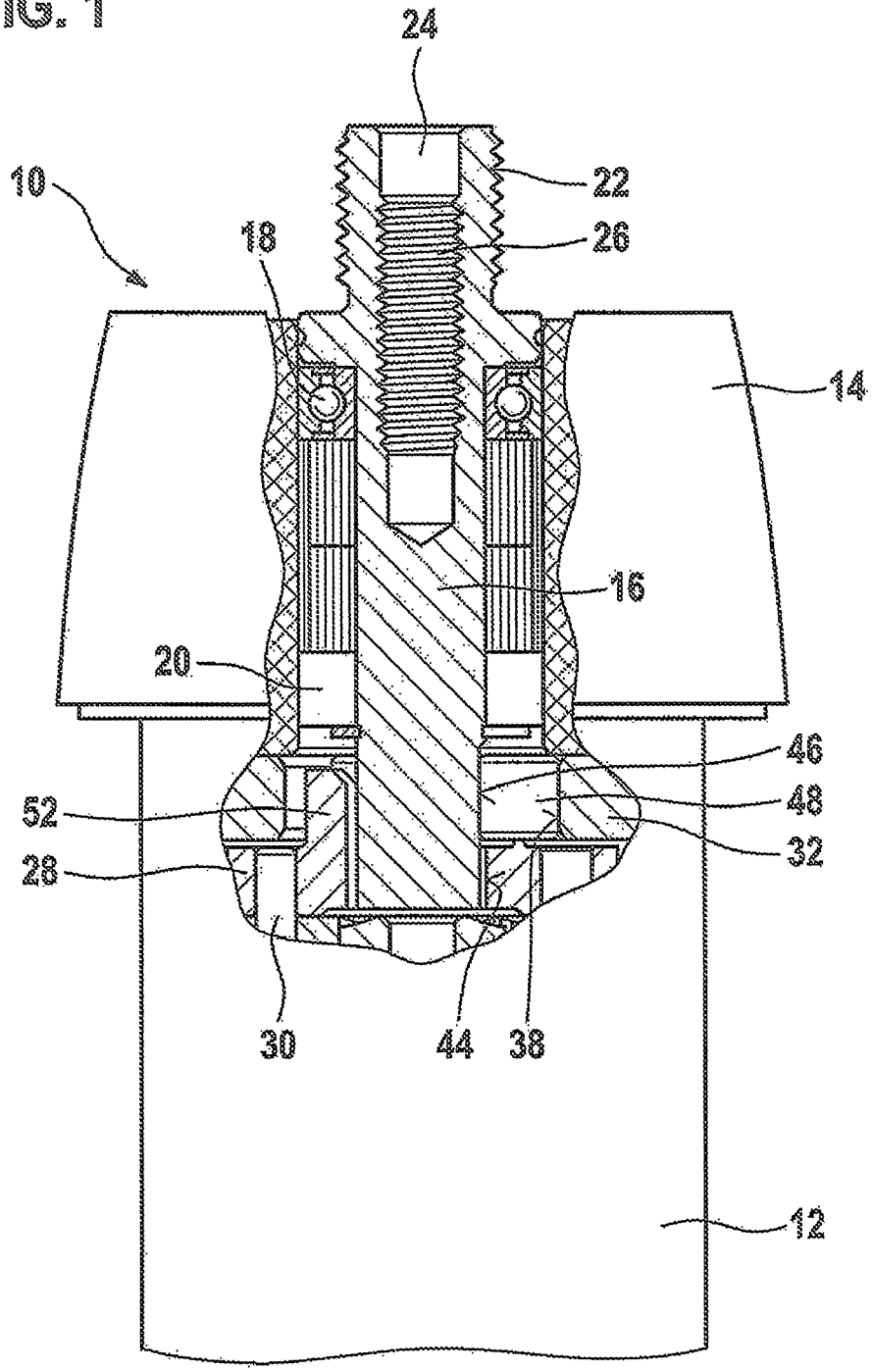
FIG. 1 shows a partial section of a machine tool to the extent necessary for an understanding of the present invention.
Figure 2:
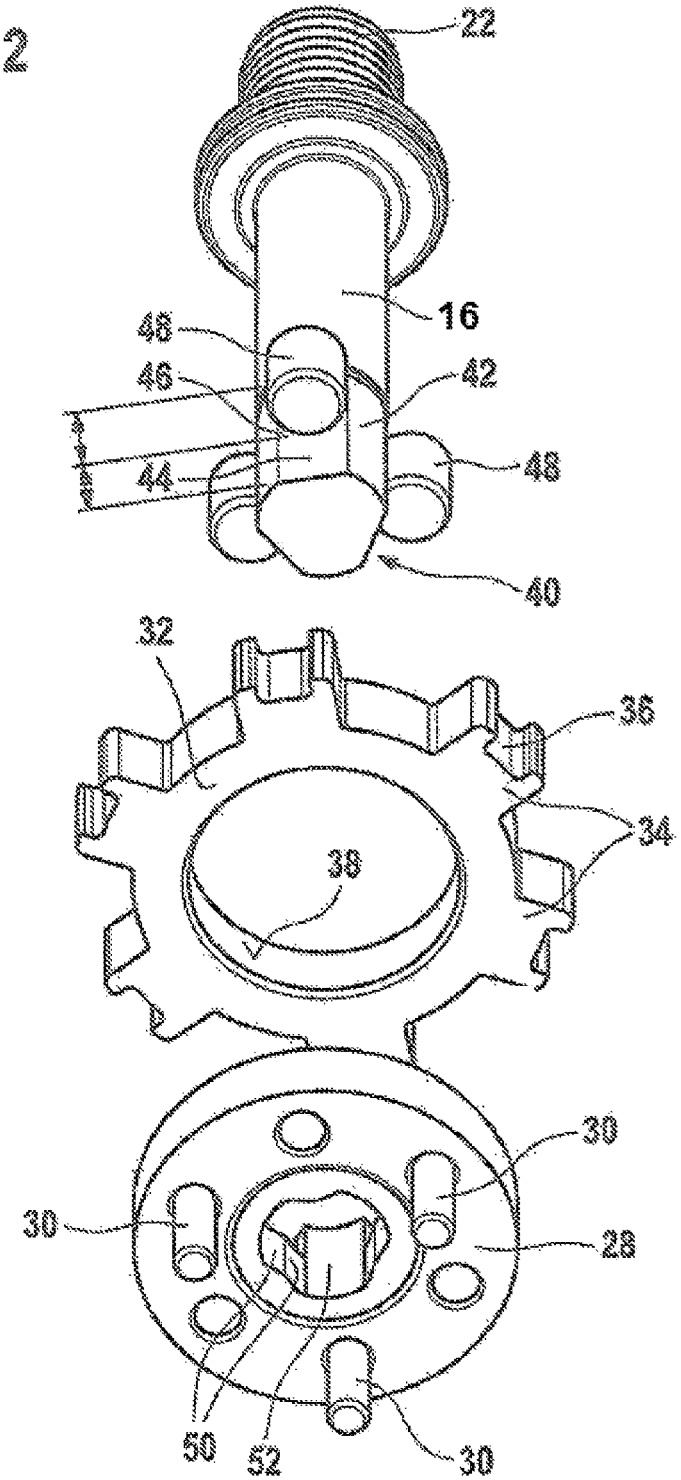
FIG. 2 shows a perspective exploded representation of a spindle lock driver.

A machine tool 10 according to FIG. 1 includes a drive device 12 and a spindle 16 which is rotationally supported in a bearing housing 14 via roller bearings 18 and 20. Spindle 16 has an external thread 22 on its free end and an internal thread 26 in a bore 24. Threads 22, 26 are used for attaching tools or tool holders, for example, chucks, or the like. However, the end of spindle 16 may also be designed differently to make it possible to accommodate tools via quick-action devices.

Drive device 12 normally contains an electric motor (not shown in greater detail) having its control and operating elements and a mechanical reduction gear, the end stage of which is designed as a planetary gear set in the exemplary embodiment and its planet carrier 28 drives spindle 16. Planetary gears (not shown in greater detail) are supported on planet shafts 30 on planet carrier 28.

The end of spindle 16 facing planet carrier 28 has the shape of a prism and together with a driving profile 40 forms an output part. Edges 42 of prismatic driving profile 40 are rounded and form partial surfaces of a cylinder, the axis of which is coaxial to the axis of rotation of spindle 16. Planet carrier 28, which is used as an input part, is guided on rounded edges 42 using guides 52, guides 52 projecting axially over the face of planet carrier 28 facing spindle 16.

The prism surfaces lying between edges 42 act as clamping surfaces 46 in a first part, while they act as driving surfaces 44 in a second part facing planet carrier 28. Driving surfaces 44 engage in a central opening of planet carrier 28 and are supported on corresponding drivers 50 of planet carrier 28 with a defined play which allows a defined rotational movement between planet carrier 28 and driving profile 40 of spindle 16. Clamping elements in the form of clamping rollers 48 are situated in the area of clamping surfaces 46 adjoining the free end of spindle 16. In the assembled state, they are enclosed by a locking ring 32 having a hollow cylinder surface 38. Locking ring 32 is secured against rotation in the housing of drive device 12 by cams 34 which have longitudinal grooves 36 on their periphery.

In normal operation, the torque from planet carrier 28 is transferred via drivers 50 to driving profile 40 of spindle 16. If the torque transferred from spindle 16 to planet carrier 28 exceeds the drive torque in special cases, clamping surfaces 46 shift within the play of driving profile 40 and establish a clamped joint between clamping surfaces 46 of spindle 16 and hollow cylinder surface 38 of locking ring 32 via clamping elements 48, so that the torque produced by spindle 16 is supported on the housing of drive device 12 and locks spindle 16. This function is also present if the drive direction of drive device 12 reverses.

What is claimed is:

1. A machine tool, comprising:

a drive device;

a spindle driven by the drive device, the spindle having a free end and a receiving device disposed on the free end and configured to receive at least one of (a) a tool and (b) a tool holder;

an output part joined in a rotationally fixed manner to the spindle;

an input part provided in a drive train of the drive device, the input part including drivers and being configured to transfer a torque having a defined play in the direction of rotation via the drivers to the output part while a torque acting from the spindle in the direction of the drive device and exceeding a torque on the input side is supported on the housing of the machine tool via clamping surfaces on the periphery of the output part, via clamping elements and via a locking ring having a hollow cylindrical surface, wherein the output part includes a prismatic driving profile including two or more axially parallel planes, the two or more planes including clamping surfaces and driving surfaces, the driving surfaces configured to cooperate with the drivers of the input part, and the clamping surfaces are axially offset from the driving surfaces; and wherein the input part includes a planetary gear set configured as an end stage, the planetary gear set including a planet carrier including:

a first end face facing toward the spindle;

a second end face facing toward the drive device;

a central opening extending from the first end face to the second end face; and the drivers being formed in the central opening and interacting with the driving surfaces of the driving profile of the spindle with a defined play, wherein guides are formed on the planet carrier in the circumferential direction between the drivers, the guides protruding from the first end face of the planet carrier and interacting with rounded edges of the prismatic profile, the rounded edges forming partial surfaces of a surrounding circular cylinder, wherein the clamping elements and the locking ring are arranged immediately adjacent to the first end face of the planet carrier.

2. The machine tool as recited in claim 1, wherein the driving surfaces continuously transition into the clamping surfaces.

3. The machine tool as recited in claim 1, wherein each of the driving surfaces forms one plane with a respective clamping surface.

4. The machine tool as recited in claim 1, wherein the locking ring is secured against rotation in a housing of the drive device by at least one cam.

5. The machine tool as recited in claim 4, wherein the at least one cam has at least one longitudinal groove on its periphery.

6. The machine tool as recited in claim 1, wherein the planet carrier has planet shafts configured to support planetary gears.

7. A machine tool, comprising:

a drive device;

a spindle driven by the drive device, the spindle having a free end and a receiving device disposed on the free end and configured to receive at least one of (a) a tool and (b) a tool holder;

an output part joined in a rotationally fixed manner to the spindle;

an input part provided in a drive train of the drive device, the input part including drivers and being configured to transfer a torque having a defined play in the direction of rotation via the drivers to the output part while a torque acting from the spindle in the direction of the drive device and exceeding a torque on the input side is supported on the housing of the machine tool via clamping surfaces on the periphery of the output part, via clamping elements and via a locking ring having a hollow cylindrical surface, wherein the output part includes a prismatic driving profile including two or more axially parallel planes, the two or more planes including clamping surfaces and driving surfaces, the driving surfaces configured to cooperate with the drivers of the input part, and the clamping surfaces are axially offset from the driving surfaces; and wherein the input part includes a planetary gear set configured as an end stage, the planetary gear set including a planet carrier including:

a first end face facing toward the spindle;

a second end face facing toward the drive device;

a central opening extending from the first end face to the second end face; and the drivers being formed in the central opening and interacting with the driving surfaces of the driving profile of the spindle with a defined play, wherein the clamping elements and the locking ring are arranged immediately adjacent to the first end face of the planet carrier.

* * * * *